US009754758B2

(12) United States Patent
Park et al.

(10) Patent No.: US 9,754,758 B2
(45) Date of Patent: Sep. 5, 2017

(54) X-RAY SOURCE HAVING COOLING AND SHIELDING FUNCTIONS

(75) Inventors: Hun Kuk Park, Seoul (KR); Je Hwang Ryu, Seoul (KR); Kyu Chang Park, Seoul (KR)

(73) Assignee: University-Industry Cooperation Group of Kyung Hee University, Yongin-si (KR)

( * ) Notice: Subject to any disclaimer, the term of this patent is extended or adjusted under 35 U.S.C. 154(b) by 839 days.

(21) Appl. No.: 14/239,483

(22) PCT Filed: Aug. 17, 2012

(86) PCT No.: PCT/KR2012/006569
§ 371 (c)(1),
(2), (4) Date: May 19, 2014

(87) PCT Pub. No.: WO2013/025080
PCT Pub. Date: Feb. 21, 2013

(65) Prior Publication Data

US 2014/0247923 A1 Sep. 4, 2014

(30) Foreign Application Priority Data

Aug. 18, 2011 (KR) ..... 10-2011-0082471

(51) Int. Cl.
*H01J 35/12* (2006.01)
*H01J 35/14* (2006.01)
(Continued)

(52) U.S. Cl.
CPC ..... *H01J 35/12* (2013.01); *H01J 35/14* (2013.01); *H01J 35/16* (2013.01);
(Continued)

(58) Field of Classification Search
CPC ..... H01J 2235/1216; H01J 2235/166; H01J 35/12; H01J 35/14; H01J 35/16; H01J 2235/1204; H05G 1/025
See application file for complete search history.

(56) References Cited

U.S. PATENT DOCUMENTS 3,298,083 A * 1/1967 Kelly ..... H01J 3/027 228/122.1
5,517,545 A * 5/1996 Nakamura ..... H05G 1/06 378/101
(Continued)

FOREIGN PATENT DOCUMENTS

JP 11-120947 4/1999
JP 2010-257902 11/2010
(Continued)

OTHER PUBLICATIONS

Peng, "Design and Characterization of a Multi-beam Micro-CT Scanner based on a Carbon Nanotube Field Emission X-ray Technology", 2010, PhD Thesis, University of North Carolina at Chapel Hill, 149 pages.*
(Continued)

*Primary Examiner* — David J Makiya
*Assistant Examiner* — John Corbett
(74) *Attorney, Agent, or Firm* — Seed IP Law Group LLP

(57) ABSTRACT

Disclosed herein is an X-ray source having cooling and shielding functions. The X-ray source includes an X-ray generation unit (100) which has one or more insulation columns (160) and emits X-rays in a vacuum; a cooling unit (180) which is provided around a periphery of the X-ray generation unit and removes heat generated from the X-ray generation unit; and a shielding unit (190) which is provided around a periphery of the cooling unit and shields an area exposed to X-rays other than the areas related to the emission of the X-rays.

12 Claims, 12 Drawing Sheets

(51) Int. Cl.
*H01J 35/16* (2006.01)
*H05G 1/02* (2006.01)

(52) U.S. Cl.
CPC ..... *H01J 2235/1204* (2013.01); *H01J 2235/1216* (2013.01); *H01J 2235/166* (2013.01); *H05G 1/025* (2013.01)

(56) References Cited

U.S. PATENT DOCUMENTS 6,257,762 B1* 7/2001 Guzik ..... H05G 1/02 205/131
2001/0002208 A1* 5/2001 Matsushita ..... H01J 35/06 378/138
2004/0046506 A1* 3/2004 Kawai ..... H01J 61/68 313/634
2012/0257723 A1* 10/2012 Kim ..... H01J 35/045 378/138

FOREIGN PATENT DOCUMENTS

KR 10-2001-0042510 A 5/2001
KR 10-2003-0074605 A 9/2003
KR 101070091 B1 10/2011

OTHER PUBLICATIONS

Phan, Design of Next generation Stationary Digital Breast Tomosynthesis System, 2010, Master's Thesis, University of North Carolina at Chapel Hill, 41 pages.*

* cited by examiner (a)

(b)

(c)

X-RAY SOURCE HAVING COOLING AND SHIELDING FUNCTIONS

TECHNICAL FIELD

The present invention relates, in general, to X-ray machines and, more particularly, to an X-ray source having cooling and shielding functions which is configured such that the X-ray source is prevented from overheating, areas other than the areas related to emission of X-rays can be shielded from X-rays, and variation in the trajectory of emitted electrons can be easily controlled.

BACKGROUND ART

Generally, X-ray sources are conventionally X-ray tubes and use a kind of vacuum tube to emit electrons accelerated under high voltage. The emitted electrons collide with a metal target, thus creating X-rays. According to their methods of creating X-rays, the X-ray sources are classified into hot cathode X-ray tubes and cold cathode X-ray tubes.

However, the filament-type X-ray tube used in such an X-ray source is disadvantageous in that the volume thereof is required to be large in order to emit a significant number of electrons. Given this, recently, a synchrotron (a particle accelerator in which a magnetic field and the number of vibrations of an electric oscillator vary with time so that the radius of a charged particle that is in a circular motion is maintained constant), a laser plasma accelerator which uses a high-powered laser and a solid target, and a thermionic electron emission device or the like have been used as electron emitting sources.

These conventional X-ray sources have the advantage of high average output power. However, high voltage is required for high output power, and when high voltage is rapidly applied to an anode electrode of an X-ray source, heat generated from the anode electrode overheats the X-ray source, thus damaging the entirety of the X-ray machine.

That is, when electrons emitted from an emitter collide with a metal plate of the anode electrode, heat of 2000° C. or more is generally generated. If the anode electrode is made of copper, it is melted by the heat. In the case of tungsten or molybdenum, the temperature is almost close to the melting point thereof.

Thereby, the vacuum of the X-ray source which emits X-rays is destroyed, and high current is generated. As a result, the X-ray machine may malfunction.

Furthermore, the amount of radioactivity of X-rays emitted from the X-ray source increases in proportion to the voltage supplied to the X-ray source. In other words, an excessive amount of radiation is discharged, whereby the degree of radiation exposure of an X-ray technician or the target to be tested may be severe.

Particularly, if X-rays leak from areas other than a cathode electrode, the emitter, the anode electrode, a gate electrode or a focusing electrode, which are the parts involved in the emission of X-rays, the X-ray technician may be inadvertently exposed to radiation.

Moreover, conventional X-ray light sources are problematic in that because energy of the accelerated electrons is not uniform, the quality of generated electron beams or X-rays is very low, and it is impossible to provide an electron emission device in a satisfactory size of Because the degree of the spread of initial electron emission is comparatively large, there is a disadvantage in that the size of the focusing electrode and the gate electrode are increased.

DISCLOSURE

Technical Problem

Accordingly, the present invention has been made keeping in mind the above problems occurring in the prior art, and an object of the present invention is to provide an X-ray source having cooling and shielding functions which is configured such that the X-ray source is prevented from being overheated by heat generated from an anode electrode, and areas other than the areas related to emission of X-rays can be shielded from X-rays.

Another object of the present invention is to provide an X-ray source having cooling and shielding functions in which the fixed positions of electrodes and distance between the electrodes can be adjusted by one or more insulation columns provided on a cathode electrode in the X-ray source, and variation of a trajectory of electrons emitted from an emitter can be easily controlled.

A further object of the present invention is to provide an X-ray source having cooling and shielding functions in which the fixed positions of electrodes and distance between the electrodes can be adjusted by one or more insulation columns provided on a cathode electrode in the X-ray source, and variation of a trajectory of electrons emitted from an emitter can be easily controlled.

Technical Solution

In order to accomplish the above objects, the present invention provides an X-ray source having cooling and shielding functions, including: an X-ray generation unit having one or more insulation columns and emitting X-rays in a vacuum; a cooling unit provided around a periphery of the X-ray generation unit, the cooling unit functioning to remove heat generated by the X-ray generation unit; and a shielding unit provided around a periphery of the cooling unit, the shielding unit functioning to shield areas exposed to X-rays other than the areas related to the emission of the X-rays.

The X-ray source may further include a sealing tube provided around the X-ray generation unit so as to seal the X-ray source and maintain the X-ray source in a high vacuum.

The X-ray source may further include a cover provided around the periphery of the cooling unit so as to prevent leakage of insulation oil charged into the cooling unit.

The X-ray source may further include a casing provided around a periphery of the shielding unit to prevent the shielding unit from being exposed to the outside.

The casing may be made of one selected from among stainless steels, aluminums and plastics.

The shielding unit may be made of one selected from among leads, aluminums, high molecular hydrocarbons and paraffins.

The X-ray generation unit may include: a cathode electrode; an emitter provided on the cathode electrode; an anode electrode disposed above the emitter; a gate electrode disposed between the emitter and the anode electrode; and a focusing electrode disposed between the emitter and the anode electrode. The one or more insulation columns may be provided on the cathode electrode and make adjustments in the positions of the gate electrode and the focusing electrode possible.

The gate electrode and the focusing electrode may be configured such that the one or more insulation columns pass through the gate electrode and the focusing electrode.

The emitter may be at least one type of a point light source type and a surface light source type.

Each of the one or more insulation columns may have a hollow or solid column structure, wherein when the insulation column has a hollow column structure, an electric wire is disposed in the insulation column, the electric wire being connected to an external power supply.

One or more first holes may be formed in each of the gate electrode and the focusing electrode, one or more second holes may be formed in each of the one or more insulation columns, and a power connection member may be brought into contact with the electric wire through the corresponding first and second holes, so that power is applied from the external power supply to each of the gate electrode and the focusing electrode through the power connection member.

Each of the one or more insulation columns may be made of any one material selected from the group consisting of ceramic, quartz, glass, Teflon, polymer and a mixture of these.

The fixed positions of the gate electrode and the focusing electrode may be adjusted by the one or more insulation columns, whereby a trajectory of electrons emitted from the emitter is controlled.

Advantageous Effects

According to the present invention, an X-ray source can be maintained in a high vacuum, and generated heat can be effectively removed so that the X-ray source can be prevented from overheating. In addition, areas other than the areas related to emission of X-rays can be reliably shielded from X-rays so as to minimize inadvertent exposure of a technician to radiation.

Furthermore, since the positions of electrodes can be adjusted using insulation columns provided in the X-ray source, the control of high efficiency electron emission characteristics is possible. The lifetime of the equipment can be extended by reliable electron emission characteristics so that the cost of maintenance can be reduced. Further, thanks to a reduction in the beam diameter of X-rays, high resolving power can be achieved and the output can be easily adjusted.

Moreover, because an X-ray light source using a nanomaterial is used, the kinetic energy of emitted electrons is almost constant, and the directional nature in emission of electrons is satisfactory. Therefore, the size of a focus can be easily controlled using an electrostatic lens or the like. As a result, a very clear radiographic image can be obtained.

Further, since a field emission type X-ray light source is used, the size of an X-ray focus can be electrostatically precisely adjusted, and errors resulting from inadequate clearance of the rotating shaft can be reduced. Therefore, unclear boundary phenomenon can be markedly reduced, and thereby the quality of a reconstruction image can be markedly improved.

BEST MODE

Hereinafter, a preferred embodiment of an X-ray source having cooling and shielding functions according to the present invention will be described in detail with reference to the attached drawings.

Figure 1:
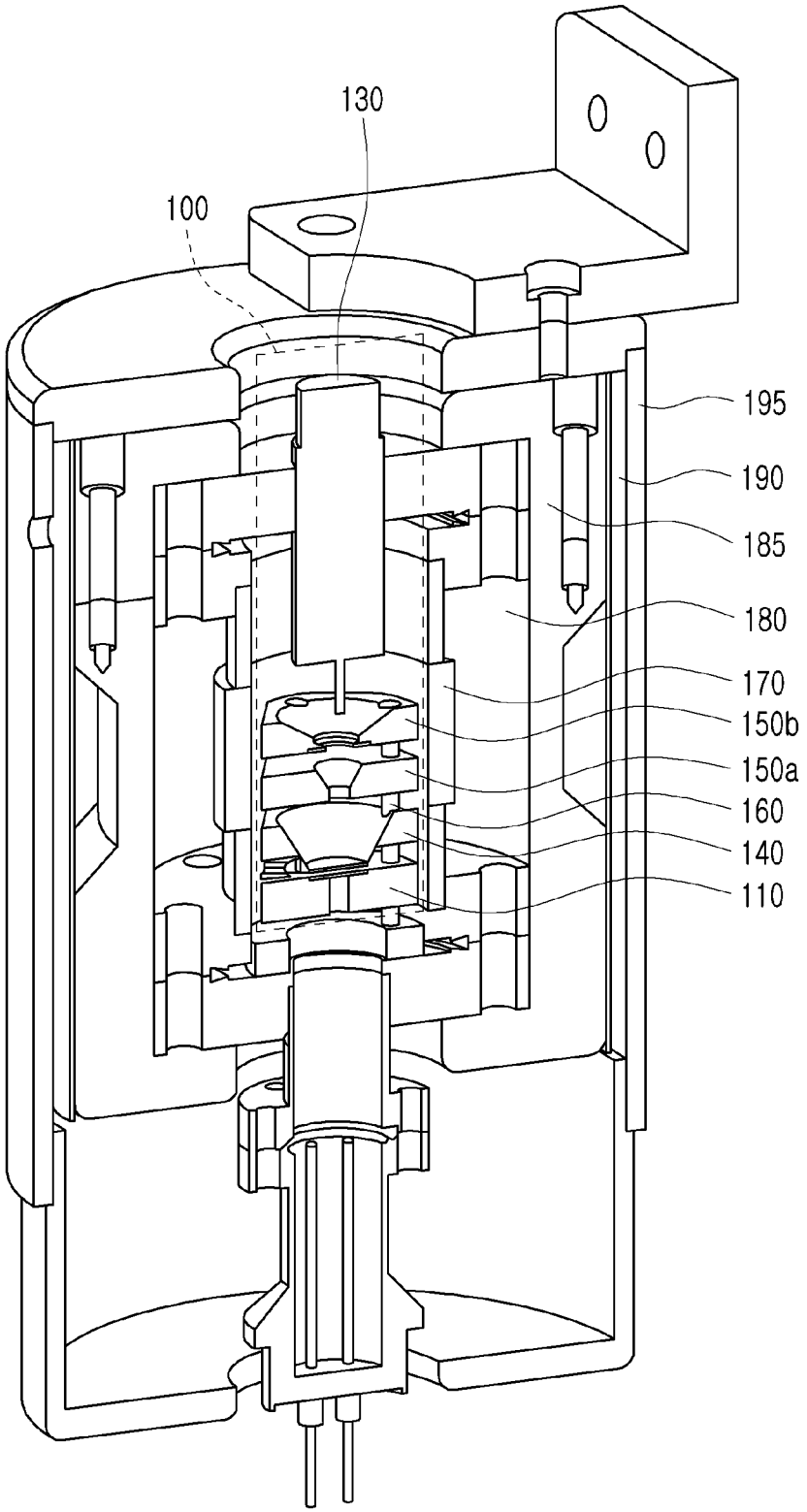
FIG. 1 is a sectional view of an X-ray source having cooling and shielding functions, according to the present invention.

FIG. 1 is a sectional view illustrating the X-ray source having the cooling and shielding functions, according to the present invention. The X-ray source includes an X-ray generation unit 100, a sealing tube 170, a cooling unit 180, a cover 185, a shielding unit 190 and a casing 195.

Figure 2:
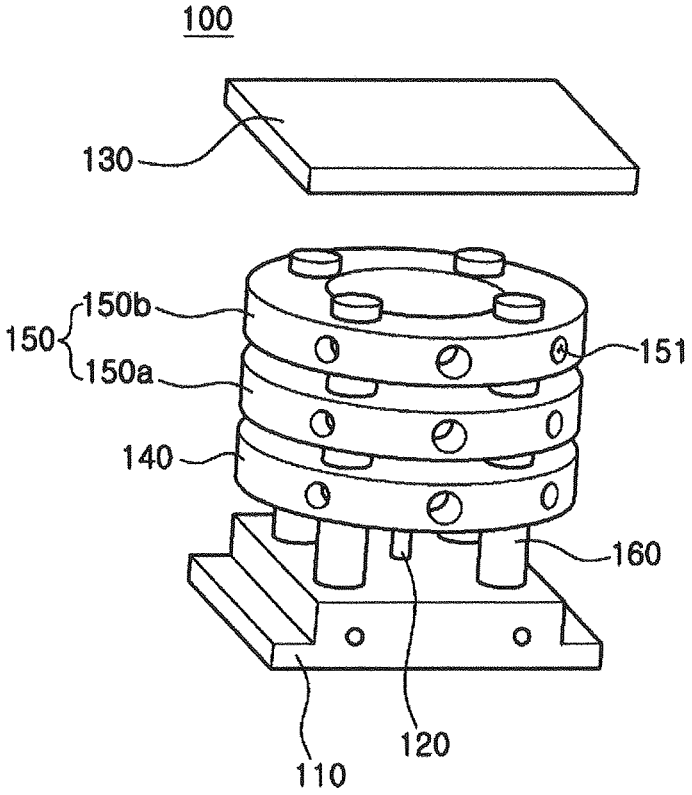
FIG. 2 is a perspective view illustrating an X-ray generation unit (100) provided in the X-ray source of FIG. 1 according to the present invention.
Figure 3:
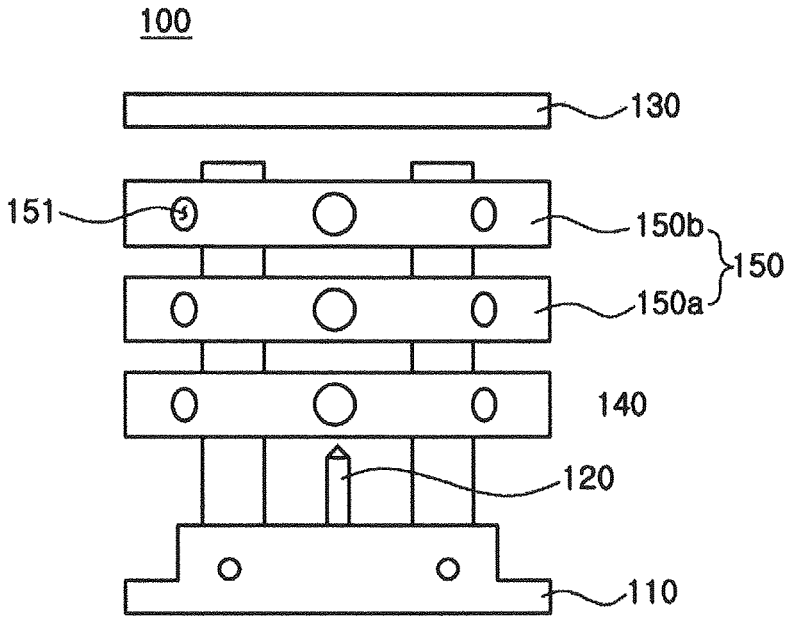
FIG. 3 is a sectional view illustrating the X-ray generation unit (100) provided in the X-ray source of FIG. 1 according to the present invention.

FIG. 2 is a perspective view illustrating the X-ray generation unit 100 provided in the X-ray source of FIG. 1 according to the present invention. FIG. 3 is a sectional view illustrating the X-ray generation unit 100 provided in the X-ray source of FIG. 1 according to the present invention. The X-ray generation unit 100 illustrated in FIGS. 2 and 3 includes a first hole 151.

Figure 4:
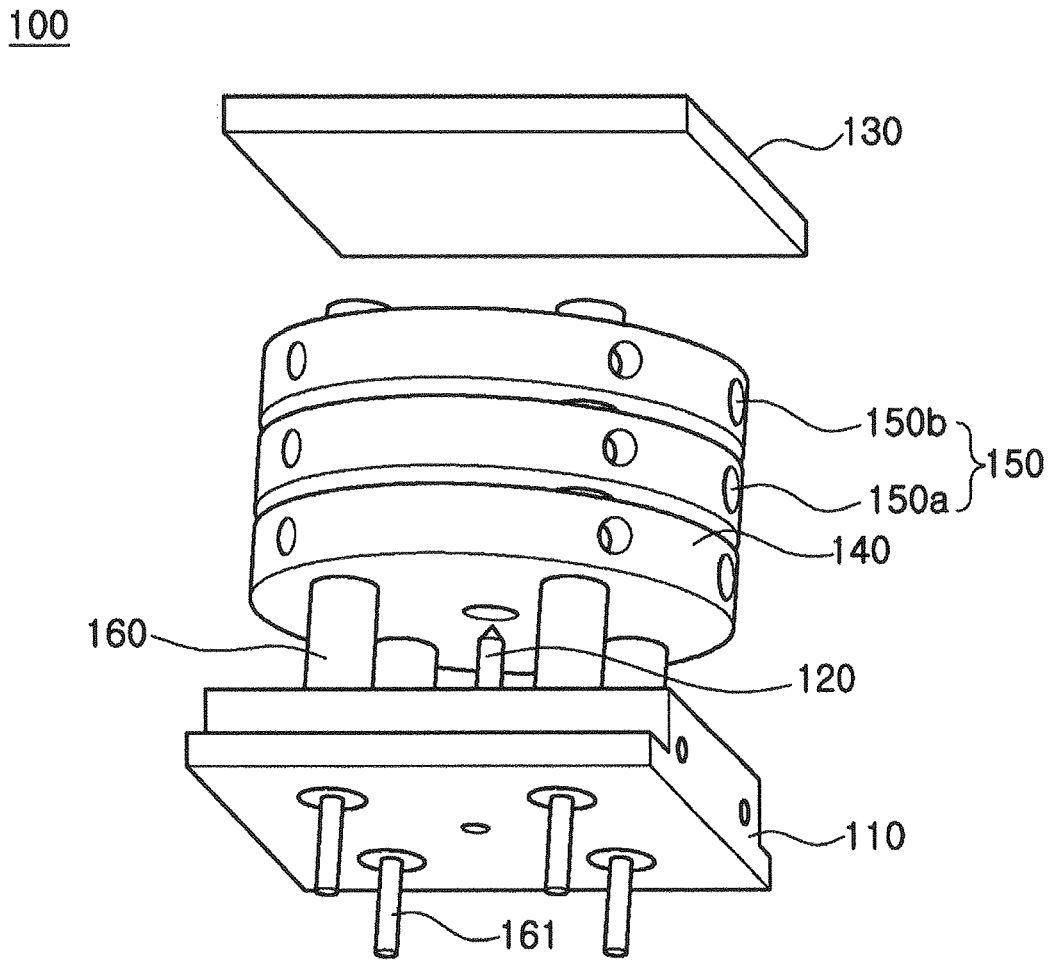
FIG. 4 is a bottom perspective view of the X-ray generation unit (100) provided in the X-ray source of FIG. 1 according to the present invention.

FIG. 4 is a bottom perspective view of the X-ray generation unit 100 provided in the X-ray source of FIG. 1 according to the present invention. The X-ray generation unit 100 includes a cathode electrode 110, an emitter 120, an anode electrode 130, a gate electrode 140, focusing electrodes 150, and one or more insulation columns 160.

Figure 5:
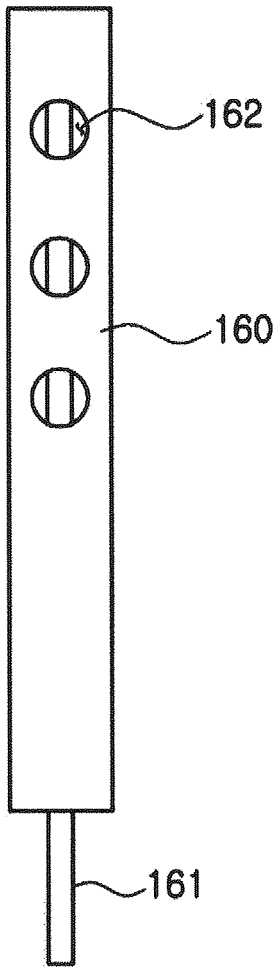
FIG. 5 is a view schematically showing an insulation column (160) used in the X-ray source of FIG. 1 according to the present invention.

FIG. 5 is a view schematically showing an insulation column 160 used in the X-ray source of FIG. 1 according to the present invention.

The functions of the elements of the X-ray source according to the present invention will be explained with reference to FIGS. 1 and 5.

The X-ray generation unit 100 includes one or more insulation columns 160 which adjust the distance between electrodes. The X-ray generation unit 100 accelerates electrons emitted from the emitter 120 such that the electrons are not scattered. The accelerated electrons collide with the anode electrode 130, thus creating X-rays which are reflected by it or pass through it in a vacuum.

The sealing tube 170 is a tubular structure which seals and encloses the periphery of the X-ray generation unit 100. The sealing tube 170 maintains the X-ray source in a high-degree vacuum.

The cooling unit 180 is configured in such a way that a space formed around the X-ray generation unit 100 and the sealing tube 170 is filled with insulation oil or circulation air so that an insulation state between the anode electrode 130 and the air can be maintained. In addition, the cooling unit 180 removes heat emitted from the anode electrode 130 and the sealing tube 170, thus preventing the X-ray source from overheating.

The cover 185 is provided around the periphery of the cooling unit 180 so as to prevent leakage of insulation oil that is charged in the cooling unit 180.

The shielding unit 190 is made of lead and is provided around the periphery of the cover 185 to shield the areas, except for the area related to the emission of X-rays, thus minimizing exposure of a technician to radiation.

The casing 195 is made of glass and is provided around the periphery of the shielding unit 190 to cover the shielding unit 190 such that the lead-component surface of the shielding unit 190 is prevented from being exposed to the outside.

The operation of the X-ray generation unit 100 provided in the X-ray source having cooling and shielding functions according to the present invention will be described in detail with reference to FIGS. 1 and 5.

The cathode electrode 110 is placed on a board (not shown) which is made of glass, metal, quartz, silicon or alumina. A point and/or surface light source type emitter 120 which will be explained later herein is disposed on the cathode electrode 110.

The one or more insulation columns 160 are provided on the cathode electrode 110, and the gate electrode 140 and the focusing electrodes 150 are separably fastened to the insulation columns 160 so that the positions of the electrodes and the distance therebetween can be easily controlled. This will be explained in detail later herein.

The emitter 120 functions to emit electrons. In this embodiment, the emitter 120 is illustrated as having a point light source type structure.

Such a point light source type emitter 120 is limited to a special shape so long as a front end thereof has a pointed shape. Preferably, the shape of the point light source type emitter 120 is one of a conical shape, a tetrahedral shape, a pointed cylindrical shape and a pointed polyhedral shape.

Furthermore, the point light source type emitter 120 is configured such that the diameter of the bottom thereof ranges about 0.1 mm to 4 mm, and the height thereof ranges several nm to several cm. The reason for this is due to the fact that, when the emitter 120 has the above-mentioned size and volume, it can effectively emit electrons as a point light source and the effects of the present invention can be reliably achieved.

The kind of the emitter 120 is not limited, but it is preferable that it is made of conductive material such as metal or carbon-based material.

Meanwhile, not only a point light source type emitter but also a surface light source type emitter may be used as the emitter 120 depending on the trajectory of emitted electrons or the performance of the X-ray source. Preferably, a surface light source type emitter is formed of a carbon structure or metal structure that is formed on a silicon, metal or carbon-based substance.

The anode electrode 130 is disposed on an upper end of the emitter 120.

The anode electrode 130 is provided with electrodes and/or a DC power supply (not shown) to apply power thereto. The structure for this is well known and, in this specification, further explanation thereof will be omitted.

Preferably, the material of the anode electrode 130 is one selected from the group consisting for copper, tungsten, manganese, molybdenum and a combination of these materials. Furthermore, in the case of a thin X-ray machine, the anode electrode 130 may be made of a thin metal film.

In this construction, when the emitter 120 emits electrons, they collide with metal constituting the anode electrode 130 and are reflected by it or pass through it, thus creating X-rays.

The gate electrode 140 is disposed between the emitter 120 and the anode electrode 130. The gate electrode 140 functions to increase the amount of electrons emitted from the emitter 120 and accelerate the speed of the emitted electrons.

The focusing electrodes 150*a* and 150*b* are disposed between the gate electrode 140 and the anode electrode 130. The focusing electrode 150 makes electrons emitted from the emitter 120 move towards the anode electrode 130 without being spread or scattered.

In the drawings, although the X-ray source is illustrated as having a single gate electrode 140 and two focusing electrodes 150*a* and 150*b*, the number of gate electrodes 140 or focusing electrodes 150*a* and 150*b* can be variously changed to adjust the trajectory of emitted electrons or depending on the performance of the X-ray source.

Furthermore, the gate electrode 140 and the focusing electrodes 150*a* and 150*b* are removably coupled to the one or more insulation columns 160 such that removal thereof from the insulation columns 160 can be easily performed.

The shapes of the gate electrode 140 and the focusing electrodes 150*a* and 150*b* are determined depending on the trajectory of electrons emitted from the emitter 120. In the drawings, each electrode has been illustrated as being a plate shaped member that has a predetermined thickness and has a circular hole therein, it may have a circular ring shape, a cylindrical shape having a hole therein, or a shape in which plates each of which has a predetermined thickness are spaced apart from each other at regular intervals.

The insulation columns 160 are configured in such a way that they are provided on the upper surface of the cathode electrode 110 or are vertically inserted into the cathode electrode 110. The insulation columns 160 function to separate the gate electrode 140 and the focusing electrodes 150*a* and 150*b* from each other and adjustably fix the positions of the gate electrode 140 and the focusing electrodes 150*a* and 150*b*.

The principle in which the positions of the gate electrode 140 and the focusing electrodes 150*a* and 150*b* are controlled by the insulation columns 160 will be described in detail.

The insulation columns 160 are configured such that they pass through the gate electrode 140 and the focusing electrodes 150*a* and 150*b*. That is, through holes corresponding to the size and shape of the insulation columns 160 are formed in each of the gate electrode 140 and the focusing electrodes 150*a* and 150*b* so that the insulation columns 160 can pass through the gate electrode 140 and the focusing electrodes 150*a* and 150*b* through the through holes. Further, one or more second holes 162 are formed in a side surface of the insulation column 160, and one or more first holes 151 are formed in a side surface of each of the gate electrode 140 and the focusing electrodes 150*a* and 150*b*.

In the drawings, although each cylindrical insulation column 160 is illustrated as having three second holes 162 in the side surface thereof, this is merely exemplary. In addition, although each of the gate electrode 140 and the focusing electrodes 150*a* and 150*b* is illustrated as having four or more first holes 151 in the side surface thereof, this is also merely exemplary.

Power connection members (not shown, for example, screws or tightening members having predetermined shapes) are inserted into the first holes 151 and the second holes 162 to fasten the corresponding electrodes to the insulation columns 160. Thereby, the gate electrode 140 and the focusing electrodes 150*a* and 150*b* can be reliably maintained at predetermined positions separated from each other.

The distances between the electrodes can be easily controlled by selectively adjusting the positions of the second holes 162 formed in each insulation column 160.

Each insulation column 160 may have a solid structure. Referring to FIG. 5, in an embodiment of the present invention, each insulation column 160 may have a hollow structure, and an electric wire 161 connected to an external power supply is disposed in the insulation column 160.

In this case, each power connection member passes through the corresponding first and second holes 151 and 162 and comes into contact with the electric wire 161 that is disposed in the insulation column 160. Thereby, power can be appropriately applied from the external power supply to the gate electrode 140 and the focusing electrodes 150*a* and 150*b*.

For instance, if a single gate electrode 140 and two focusing electrodes 150*a* and 150*b* are used for a unit X-ray source 100, it is preferable that three insulation columns 160 be provided. Although it is preferable that the emitter 120 be disposed in a central portion of the cathode electrode 110 and three insulation columns 160 be disposed around the periphery of the emitter 120, the positions of the three insulation columns 160 are not limited to this. Meanwhile, if another focusing electrode is added, it is preferable that four insulation columns 160 be provided.

The electric wires 161 which are connected to the external power supply are respectively disposed in the three insulation columns 160. Each electrode is connected to and fixed to the corresponding one insulation column 160 by the power connection member through the corresponding first hole 151 formed in the electrode and the corresponding second hole 162 formed in the insulation column 160. Thereby, power can be appropriately applied to each electrode.

Meanwhile, in the case where each insulation column 160 has a solid structure, a separate DC power supply (not shown) for applying power to each electrode is provided.

Preferably, the cross-sectional shape of each insulation column 160 is any one of a circle, an ellipse, a triangle, a rectangle, a polyhedron and a combination of these.

Furthermore, it is preferable that each insulation column 160 be made of any one material selected from the group consisting of ceramic, quartz, glass, Teflon, polymer and a mixture of these.

FIGS. 6 through 11 are views successively showing a process of manufacturing the X-ray source of FIG. 1 according to the present invention.

The process of manufacturing the X-ray source according to the present invention will be explained with reference to FIGS. 1 through 11.

Figure 6:
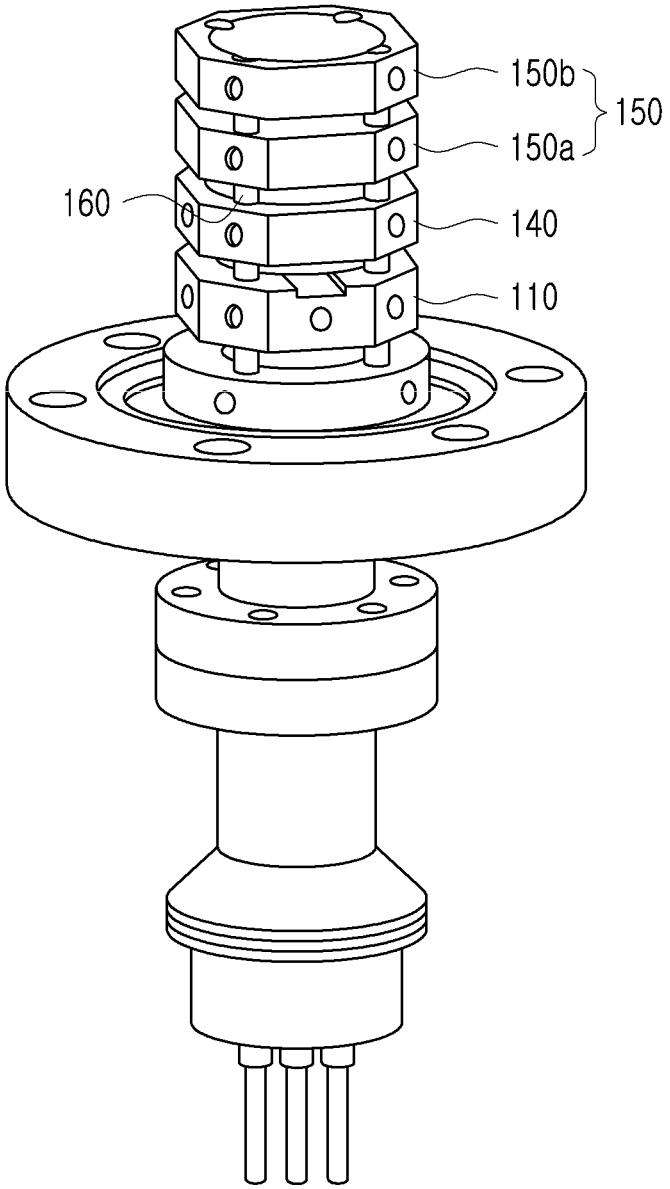
FIGS. 6 through 11 are views successively showing a process of manufacturing the X-ray source of FIG. 1 according to the present invention.

As shown in FIG. 6, the cathode electrode 110 is provided on the board (not shown). The point and/or surface light source type emitter 120 is provided on the cathode electrode 110.

The one or more insulation columns 160 are provided upright on the upper surface of the cathode electrode 110. The gate electrode 140 is disposed above the cathode electrode 110 at a position spaced apart from the cathode electrode 110 by a predetermined distance and is provided on the insulation columns 160 through the through holes of the gate electrode 140.

The focusing electrodes 150*a* and 150*b* are disposed above the gate electrode 140 at positions spaced apart from the gate electrode 140 by predetermined distances and are provided on the insulation columns 160 through the through holes of the focusing electrodes 150*a* and 150*b*.

Meanwhile, to make it possible to selectively fix or adjust the positions of the gate electrode 140 and the focusing electrodes 150*a* and 150*b*, the one or more second holes 162 are formed in the side surface of each insulation column 160, and the one or more first holes 151 are formed in the side surface of each of the gate electrode 140 and the focusing electrodes 150*a* and 150*b*.

Figure 7:
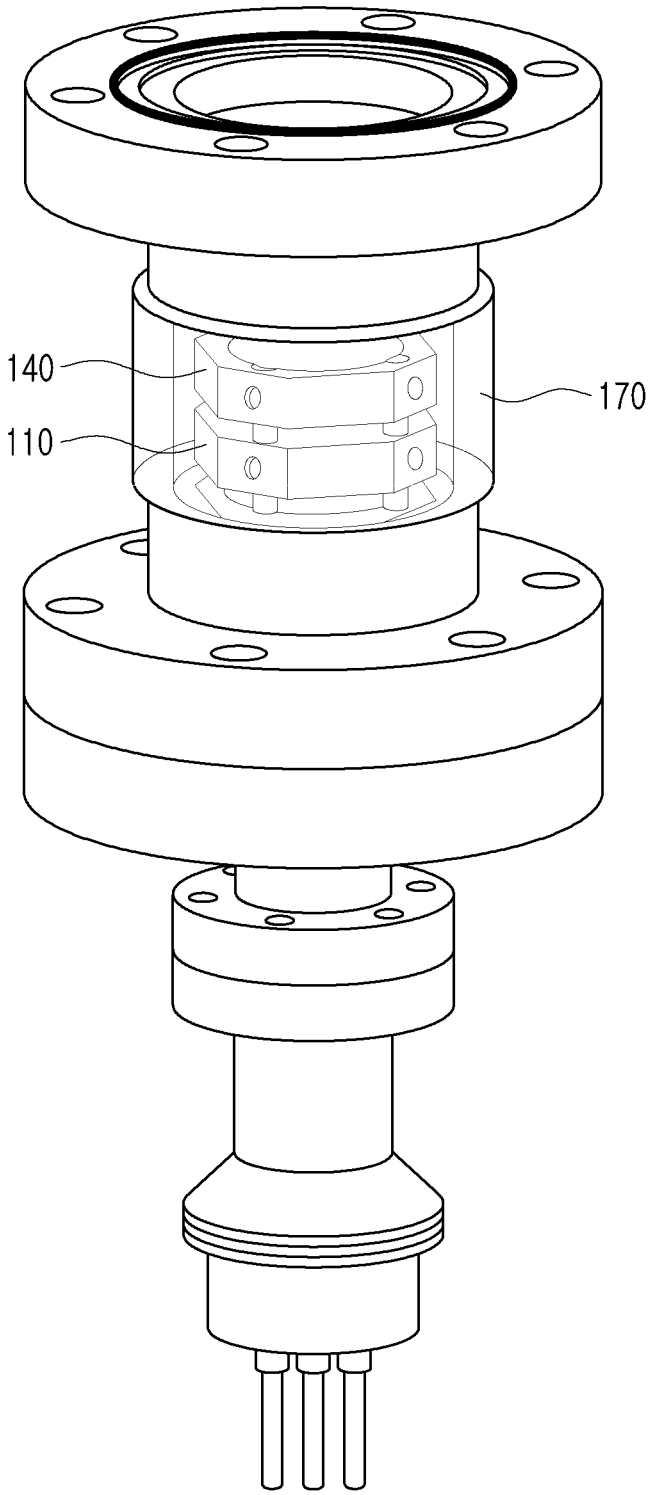

As shown in FIG. 7, the sealing tube 170 is provided around the cathode electrode 110, the emitter 120, the gate electrode 140, the focusing electrodes 150 and the one or more insulation columns 160 that have been manufactured through the manufacturing process shown in FIG. 6.

Figure 8:
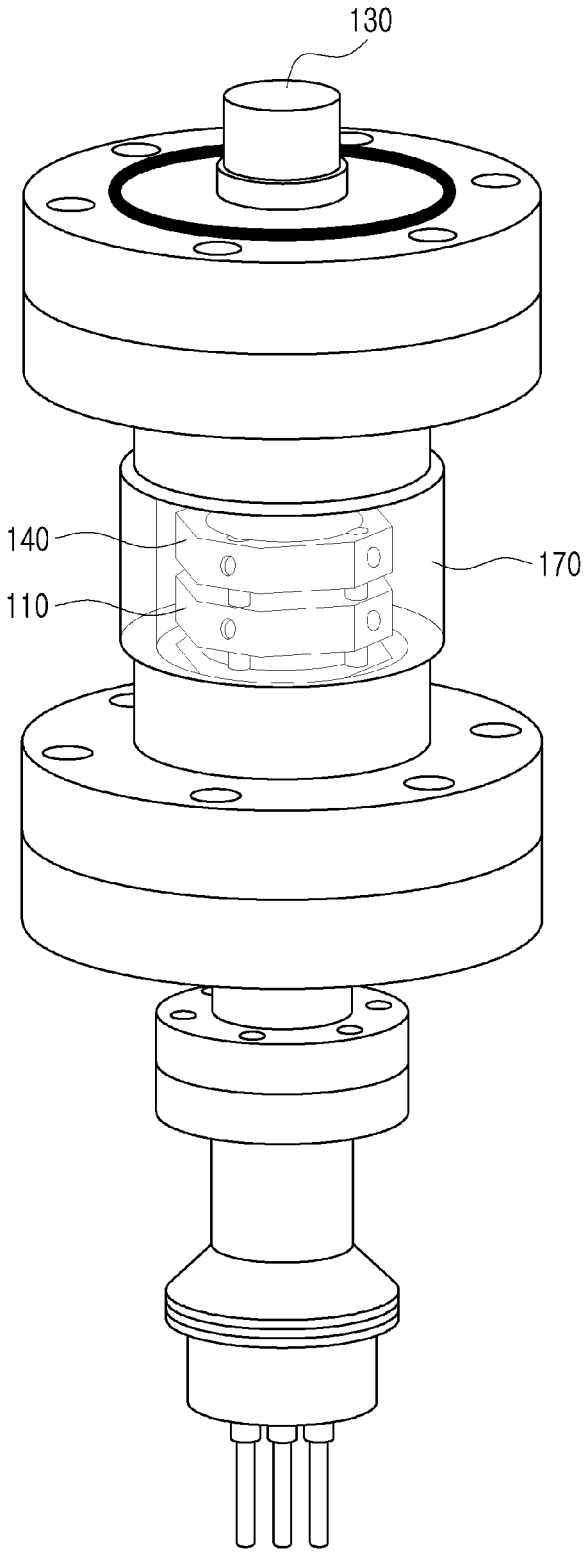

As shown in FIG. 8, the anode electrode 130 is provided above the emitter 120 which has been manufactured through the manufacturing process shown in FIG. 7, thus forming a reflective X-ray type structure having a predetermined angle.

Figure 9:
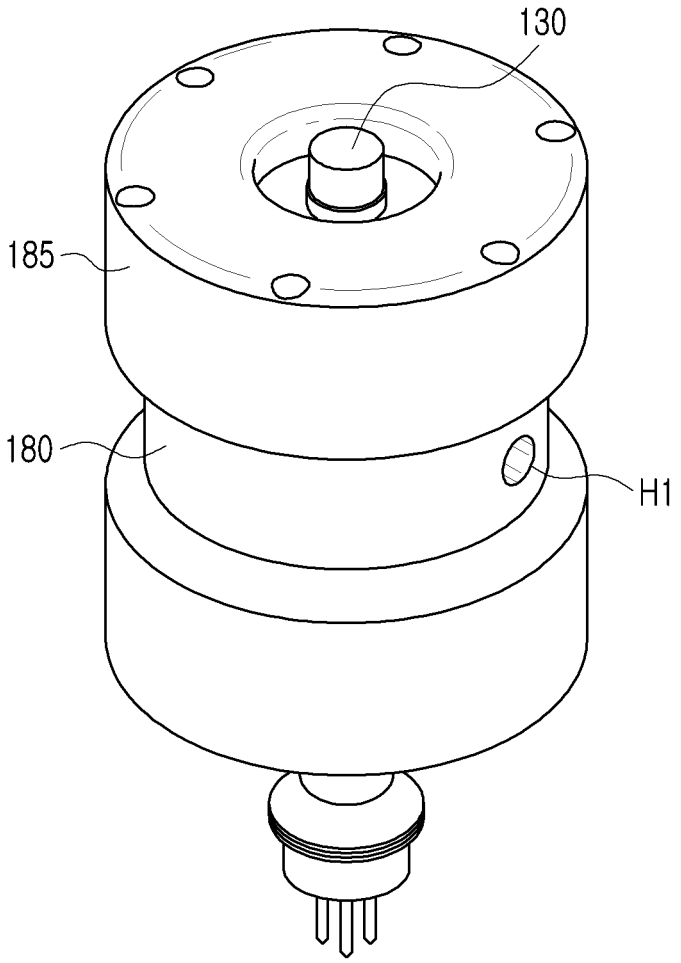

As shown in FIG. 9, the cooling unit 180 and the cover 185 are provided around the cathode electrode 110, the emitter 120, the gate electrode 140, the focusing electrodes 150, the one or more insulation columns 160, the sealing tube 170 and the anode electrode 130 that have been manufactured through the manufacturing process shown in FIG. 8.

The cooling unit 180 is filled with insulation oil or circulation air. The reason for this is to prevent retention of heat generated by collision of electrons emitted from the emitter 120 when the anode electrode 130 is exposed to the air.

The cooling unit 180 has therein a first emission hole H1 through which X-rays generated from the X-ray generation unit 100 are emitted out of the X-ray source.

Figure 10:
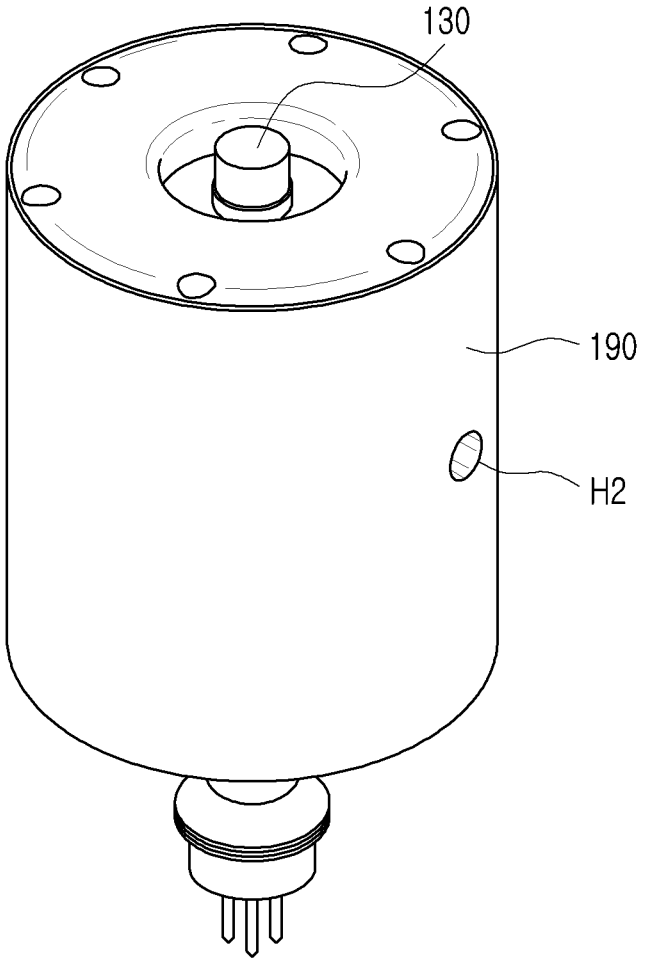

As shown in FIG. 10, the shielding unit 190 made of lead is provided around the cover 185 which has been manufactured through the manufacturing process shown in FIG. 9.

In the same manner, a second emission hole H2 is formed in the shielding unit 190 at a position corresponding to the first emission hole H1 of the cooling unit 180. X-rays generated from the X-ray generation unit 100 are emitted out of the X-ray source through the second emission hole H2.

In this embodiment, although the shielding unit 190 has been illustrated as being made of lead, it may also be made of aluminum, high molecular hydrocarbons or paraffin which can shield X-rays to minimize exposure to radiation.

Figure 11:
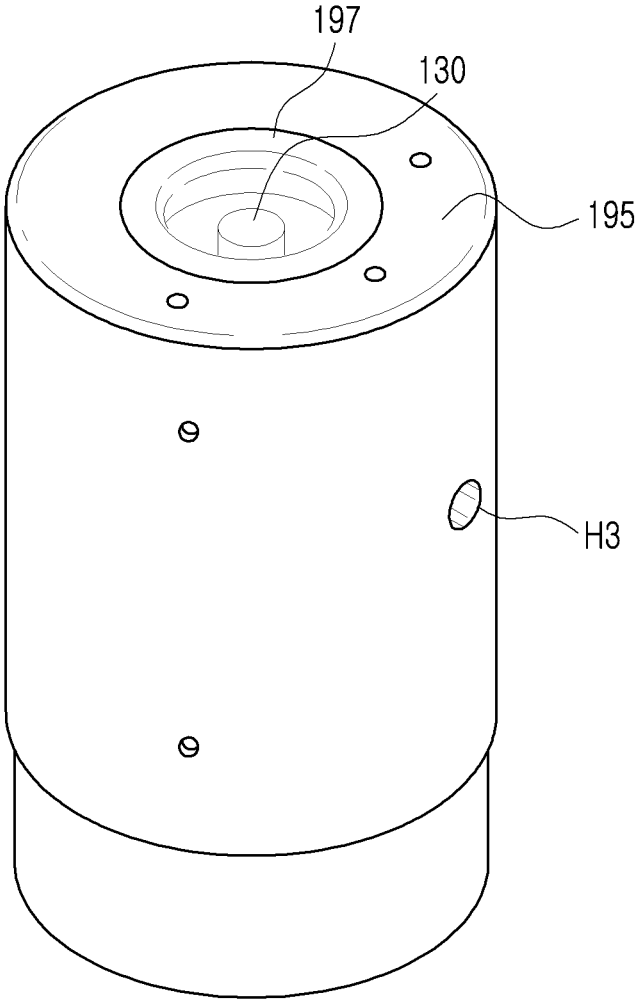

As shown in FIG. 11, the casing 195 which is made of metal is provided around the shielding unit 190 that has been manufactured through the manufacturing process of FIG. 10.

In the same manner, a third emission hole H3 is formed in the shielding unit 190 at a position corresponding to the first emission hole H1 of the cooling unit 180 and the second emission hole H2 of the shielding unit 190, and X-rays generated from the X-ray generation unit 100 are emitted out of the X-ray source through the emission hole H3.

The casing 195 is preferably made of metal such as stainless steel-based metal or aluminum-based metal which is typically used for the sheaths of medical devices, but it can also be made of plastic-based material.

In a manner similar to the process of FIG. 9, space between the anode electrode 130 and the casing 195 is filled with insulation oil or circulation air. Thereafter, an oil cover 197 is provided.

The reason for this is to prevent retention of heat generated by collision of electrons emitted from the emitter 120 when the anode electrode 130 is exposed to the air.

Figure 12:
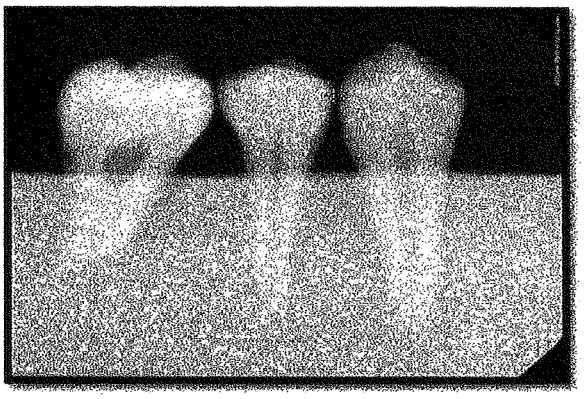
FIG. 12 is of photographs comparing an X-ray image of dental caries captured by the X-ray source according to the present invention with X-ray images captured by conventional X-ray sources.
Figure 12:
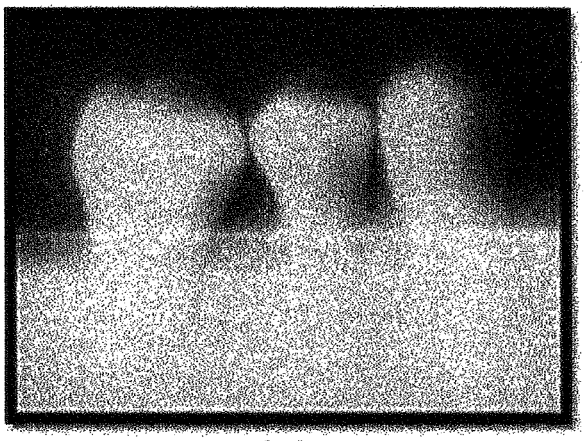
Figure 12:
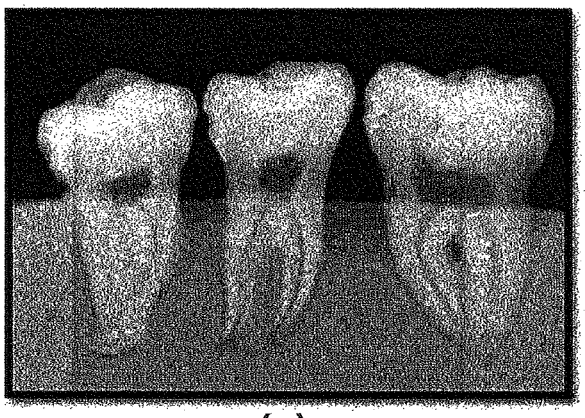

FIG. 12 is of photographs comparing an X-ray image of dental caries captured by the X-ray source according to the present invention with X-ray images captured by conventional X-ray sources. FIG. 12*a* is an image captured by a conventional general X-ray source. FIG. 12*b* is an image captured by a conventional X-ray source that has no focusing electrode. FIG. 12*c* is an image captured by the X-ray source having cooling and shielding functions according to the present invention.

As shown in FIG. 12*a*, in the case of the image captured by the conventional general X-ray source, despite high X-ray dosage (2.4 mAs), the internal structures of teeth are not clearly observed. Also, as shown in FIG. 12*b*, in the case of the image captured by the conventional X-ray source having no focusing electrode, despite high X-ray dosage (2.5 mAs), the image is blurred and the appearances and internal structures of teeth are not clearly observed.

On the other hand, as shown in FIG. 12*c*, in the case of the image captured by the X-ray source having cooling and shielding functions according to the present invention, despite low X-ray dosage (2.1 mAs), the appearance of teeth is clear, and even caries that are present in the teeth are also clearly observed.

As described above, if the X-ray source having cooling and shielding functions according to the present invention is used, the X-ray source can be maintained in a high vacuum, generated heat can be effectively removed so that the X-ray source can be prevented from overheating, and the areas other than the area related to emission of X-rays can be reliably shielded from X-rays so as to minimize inadvertent exposure of a technician to radiation.

Furthermore, thanks to the one or more insulation columns 160 provided on the cathode electrode 110 in the X-ray source, the installation positions of the electrodes and the distances between the electrodes can be easily adjusted. In addition, variation of the trajectory of electrons emitted from the emitter 120 can be easily controlled so that the control of high efficiency electron emission characteristics is possible. Furthermore, the lifetime of the equipment can be extended by reliable electron emission characteristics so that the cost of maintenance can be reduced. Further, thanks to a reduction in beam diameter of X-rays, high resolving power can be achieved and the output can be easily adjusted.

Moreover, in the X-ray source according to the present invention, because an X-ray light source of a field emission type using a nano-material is used, the kinetic energy of emitted electrons is almost constant, and the directional nature in emission of electrons is satisfactory. Therefore, the size of a focus can be easily controlled using an electrostatic lens or the like. As a result, a very clear radiographic image can be obtained. Further, since the size of an X-ray focus can be electrostatically precisely adjusted, and errors resulting from inadequate clearance of the rotating shaft can be reduced, unclear boundary phenomenon can be markedly reduced, and thereby qualitative improvement of a reconstruction image can be obtained.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. An X-ray source having cooling and shielding functions, comprising:

an X-ray generation unit emitting X-rays in a vacuum, the X-ray generation unit comprising a gate electrode, a focusing electrode, and one or more insulation columns;

a cooling unit provided around a periphery of the X-ray generation unit, the cooling unit functioning to remove heat generated from the X-ray generation unit; and a shielding unit provided around a periphery of the cooling unit, the shielding unit functioning to shield areas exposed to X-rays other than the areas related to the emission of the X-rays, wherein the gate electrode and the focusing electrode have one or more first holes and are configured such that the one or more insulation columns pass through the gate electrode and the focusing electrode, wherein the one or more insulation columns detachably extend through the gate electrode and the focusing electrode in a first direction and are provided with one or more second holes, and wherein the one or more first holes extend in a second direction and open outward, and the one or more second holes are configured to be in communication with at least one of the one or more first holes by adjusting positions of the gate electrode and the focusing electrode along the first direction.

2. The X-ray source having cooling and shielding functions of claim 1, further comprising a sealing tube provided around the X-ray generation unit, the sealing tube functioning to seal the X-ray source and maintaining the X-ray source in a high vacuum.

3. The X-ray source having cooling and shielding functions of claim 1, further comprising a cover provided around the periphery of the cooling unit, the cover functioning to prevent leakage of insulation oil charged into the cooling unit.

4. The X-ray source having cooling and shielding functions of claim 1, further comprising a casing provided around a periphery of the shielding unit functioning to prevent the shielding unit from being exposed to the outside.

5. The X-ray source having cooling and shielding functions of claim 4, wherein the casing is made of one selected from among stainless steels, aluminums and plastics.

6. The X-ray source having cooling and shielding functions of claim 1, wherein the shielding unit is made of one selected from among leads, aluminums, high molecular hydrocarbons and paraffins.

7. The X-ray source having cooling and shielding functions of claim 1, wherein the X-ray generation unit further comprises:

a cathode electrode;

an emitter provided on the cathode electrode; and an anode electrode disposed over the emitter;

wherein the gate electrode is disposed between the emitter and the anode electrode, wherein the focusing electrode is disposed between the emitter and the anode electrode, and wherein the one or more insulation columns are provided on the cathode electrode.

8. The X-ray source having cooling and shielding functions of claim 7, wherein the emitter has a front end with a pointed shape.

9. The X-ray source having cooling and shielding functions of claim 7, wherein each of the one or more insulation columns has a hollow or solid column structure, wherein when the insulation column has a hollow column structure, an electric wire is disposed in the insulation column, the electric wire being connected to an external power supply.

10. The X-ray source having cooling and shielding functions of claim 9, wherein a power connection member is brought into contact with the electric wire through the corresponding first and second holes, so that power is applied from the external power supply to each of the gate electrode and the focusing electrode through the power connection member.

11. The X-ray source having cooling and shielding functions of claim 7, wherein each of the one or more insulation columns is made of any one material selected from the group consisting of ceramic, quartz, glass, Teflon, polymer and a mixture of these.

12. The X-ray source having cooling and shielding functions of claim 7, wherein the fixed positions of the gate electrode and the focusing electrode are adjusted by the one or more insulation columns, whereby trajectory of electrons emitted from the emitter is controlled.

* * * * *